US008486226B1

(12) United States Patent
Veverka et al.

(10) Patent No.: US 8,486,226 B1
(45) Date of Patent: Jul. 16, 2013

(54) LOW HYGROEXPANSIVITY PAPER SHEET

(75) Inventors: Peter J. Veverka, Schroon Lake, NY (US); Thomas D. Ruch, Queensbury, NY (US)

(73) Assignee: Finch Paper LLC., Glens Falls, NY (US)

( * ) Notice: Subject to any disclaimer, the term of this patent is extended or adjusted under 35 U.S.C. 154(b) by 0 days.

(21) Appl. No.: 13/611,842

(22) Filed: Sep. 12, 2012

(51) Int. Cl.

| | |
|---|---|
| ***D21F 11/00*** | (2006.01) |
| ***B32B 5/00*** | (2006.01) |
| ***D21H 11/04*** | (2006.01) |
| ***D21H 13/06*** | (2006.01) |

(52) U.S. Cl.
USPC ..... 162/141; 428/98; 428/340

(58) Field of Classification Search
USPC ..... 162/141; 428/98, 340
See application file for complete search history.

(56) References Cited

U.S. PATENT DOCUMENTS

| | | | | |
|---|---|---|---|---|
| 3,210,237 | A * | 10/1965 | Madison | 162/61 |
| 4,300,981 | A * | 11/1981 | Carstens | 162/109 |
| 5,562,805 | A | 10/1996 | Kamps et al. | |
| 5,622,786 | A | 4/1997 | Weber et al. | |
| 6,146,494 | A | 11/2000 | Seger et al. | |
| 6,200,419 | B1 | 3/2001 | Phan | |
| 6,387,210 | B1 | 5/2002 | Hsu et al. | |
| 7,363,179 | B1 | 4/2008 | Missell et al. | |
| 7,588,660 | B2 | 9/2009 | Edwards et al. | |
| 7,736,466 | B2 | 6/2010 | Singh et al. | |
| 2002/0129912 | A1 | 9/2002 | Reinhard et al. | |
| 2009/0020139 | A1 | 1/2009 | Sumnicht et al. | |
| 2010/0065235 | A1 | 3/2010 | Fike et al. | |
| 2010/0175840 | A1 | 7/2010 | Hart et al. | |
| 2011/0011545 | A1 | 1/2011 | Edwards et al. | |
| 2011/0168342 | A1 | 7/2011 | Mohammadi | |

FOREIGN PATENT DOCUMENTS

| | | |
|---|---|---|
| EP | 0495637 B1 | 4/1997 |
| WO | 99/11863 | 3/1999 |
| WO | 2005/066415 A1 | 7/2005 |

OTHER PUBLICATIONS

Lucisano M.F.C., Vomhoff, H. "A new instrument for measurement of the out-of-plane dimensional stability of paperboard", Inventia (formerly STFI-Packforsk) PaperCon, May 2-5, 2010.
Boise X-9 (commercially available paper), purchased Mar. 2011 and Jul. 2012.
Finch Opaque White Wove, on sale before 2010.
Kajanto, I., Niskanen, K. "Dimensional Stability", Paper Physics in Papermaking Science and Technology, 1998, p. 222-259, Chapter 7—Book 16, Fapet Oy, Jyväskylä, Finland.
Pulkkinenen I. et. al., "The Effect of Hardwood Fiber Morphology on the Hygroexpansivity of Paper", BioResources, 2009, p. 126-141, 4(1).
Uesaka, T., "Dimensional Stability of Paper: Upgrading Paper Performance in End Use", Journal of Pulp and Paper Science, 1991, p. 39-45, vol. 17, No. 2, PAPTAC, Montreal , Canada.

(Continued)

*Primary Examiner* — Eric Hug
*Assistant Examiner* — Jacob Thomas Minskey
(74) *Attorney, Agent, or Firm* — Heslin Rothenberg Farley & Mesiti P.C.

(57) ABSTRACT

A paper sheet is providing having a basis weight of 50 to 80 g/m$^2$, and having a top surface and a bottom surface, said paper sheet comprising 10%-80% by weight of hardwood kraft pulp; and 10%-70% by weight of sulfite pulp; wherein the paper sheet has an MD/CD TSI ratio of 1.25 to 2.15, and a fiber hygroexpansion stress transfer parameter (ω) of less than 0.1.

20 Claims, 6 Drawing Sheets

OTHER PUBLICATIONS

Uesaka, T., "General Formula for Hygroexpansion of Paper", Journal of Material Science, 1994, vol. 19, p. 2373-2377, Springer, New York, NY.
Shakespeare, J., "Tutorial:Fibre Orientation Angle Profiles—Process Principles and Cross Machine Control", TAPPI 1998 Process Control, Electrical & Info. Conference Proceedings, TAPPI Press, Atlanta, GA., 1998.
Green, C. "Solving curl problems: the basics", Solutions!, Nov. 2001, vol. 84(11), TAPPI Press, Atlanta, GA.
Barquin, A.C. "Effect of High Yield Pulp on the Dimensional Stability of Wood-Free Paper for Inkjet Printing Applications" M.S. Thesis, 2011, 130 pages, University of Toronto, Ontario, Canada.
Mendes , A.H.T., et. al., "The Importance of the Measurement of Paper CD Differential Shrinkage", O Papel Journal, Feb. 2012, p. 45-50, ABTCP, São Paulo, Brazil.
Marulier, A., et. al., "Modeling the Hygromechanical Behavior of Intricate Networks of Natural Fibers", Symposium Workshop-Experimental and Computational Micro-Charachterization Techniques in Wood Mechanics, Aug. 2011, Helskinki, Finland.
Pukkinen, I., et. al, "The Effect of Sample Size and Shape on the Hygroexpansion Coefficient—A Study Made with Advanced Methods for Hygroexpansion Measurement", TAPPSA Journal, Mar. 2009, p. 26-33, TAPPSA, Kloof, South Africa.
Lif, J., et. al., "In-Plane Hygro-Viscoelasticity of Paper at Small Deformations", Nordic Pulp and Paper Research Journal, 2005, vol. 20(1), p. 139-149, The Swedish Association of Pulp and Paper Engineers (SPCI) Stockholm, Sweden.
Nordstrom, A., et. al., Measuring curl of thin papers, TAPPI Journal, 1997, vol. 80(1), TAPPI Press, Atlanta, GA.
Larsson, P., "Hygro and hydroexapansion of paper—Influence of fibre-joint flexibility and fibre sorptivity", Doctoral Thesis, 2010, KTH Royal Institute of Technology, Stockholm, Sweden.
Sedlachek, K.M., "Effect of Hemicelluloses and Cyclic Humidity on the Creep of Single Fibers", Doctoral Thesis, 1995, Institute of Paper Science and Technology—Georgia Tech., Atlanta, GA.

* cited by examiner

Average Fiber Hygroexpansion Stress Transfer Parameter (ω) for Samples A-J, X-09, and X-12

Fiber Hygroexpansivity Stress Transfer Parameter (ω)
Compared to Average Curl for Samples A-J, X-09, and X-12

LOW HYGROEXPANSIVITY PAPER SHEET

FIELD OF THE INVENTION

The invention relates to a paper sheet.

BACKGROUND OF THE INVENTION

Paper is the term generally used to describe sheet materials made up of many small discrete fibers, most typically cellulosic fibers, bonded together. The source of the raw material used in the manufacture of paper is many and varied, but the dominant source is cellulosic fiber in the form of wood pulp.

In the typical papermaking process, pulp is generally beaten and refined as an aqueous slurry. Various mineral pigments may be added in a filling and loading step. The paper also may undergo a sizing treatment, which may involve adding materials to the paper in order to render the sheet more resistant to penetration by liquids, particularly water. Rosin, hydrocarbon and natural waxes, starches, glues, casein, asphalt emulsions, synthetic resins, and cellulose derivatives are among the materials used as sizing agents in the prior art. The agents may be added directly to the stock as "beater additives". In the alternative, a dry formed sheet may be passed through a size solution or over a roll wetted with a size solution. Sheet forming occurs, typically using a Fourdrinier paper machine, whereby the pulp slurry is poured onto wires, pressed and dried. Optionally, paper may be finally "converted" by undergoing some further treatment after manufacture. Among the many converting operations are embossing, impregnating, saturating, laminating, coating and sheeting. The above steps and variations thereof are well-known; see Kirk-Othmer, *Encyclopedia of Chemical Technology, Second Edition*, Vol. 14, pp. 494 et. seq. Varieties of cellulosic fiber and/or pulp sources, fillers, sizing agents, converting operations, and the like are also described in G. A. Smook, *Handbook for Pulp & Paper Technologists*, Second Edition.

The performance variables of paper sheets vary greatly depending upon the vast array of end-uses for such sheets. For laser printing, in particular, it is desirable to achieve paper sheets that minimize jamming, curls, wavy at the edges, and asymmetric shrinkage of a sheet when it is being fused. These needs are satisfied, the limitations of the prior art overcome, and other benefits realized in accordance with the principles of the present invention by providing the paper sheet as described herein.

SUMMARY OF THE INVENTION

It has now been found that a paper sheet comprising hardwood pulp and sulfite pulp minimizes printing jams and is particularly suited to laser printing applications. However, it is contemplated that the invention may prove useful in addressing other problems and deficiencies in a number of technical areas. Therefore, the claimed invention should not necessarily be construed as limited to addressing any of the particular problems or deficiencies discussed herein.

In one aspect, the invention relates to a paper sheet of 50 to 80 g/m$^2$ basis weight having a top surface and a bottom surface, said paper sheet comprising:

a. 10%-80% by weight of hardwood kraft pulp; and b. 10%-70% by weight of sulfite pulp;

and wherein the paper sheet has an MD/CD TSI ratio of 1.25 to 2.15, and a fiber hygroexpansion stress transfer parameter ($\omega$) of less than 0.1.

Without limiting the scope of the paper sheets of the present invention defined by the claims that follow, their more prominent features will now be discussed briefly. After considering this discussion, and particularly after reading the section of this specification entitled "Detailed Description of the Invention," one will understand how the features of the various embodiments disclosed herein provide a number of advantages over the current state of the art.

These and other features and advantages of this invention will become apparent from the following detailed description of the various aspects of the invention taken in conjunction with the appended claims and the accompanying drawings.

DETAILED DESCRIPTION OF THE INVENTION

Figure 1:
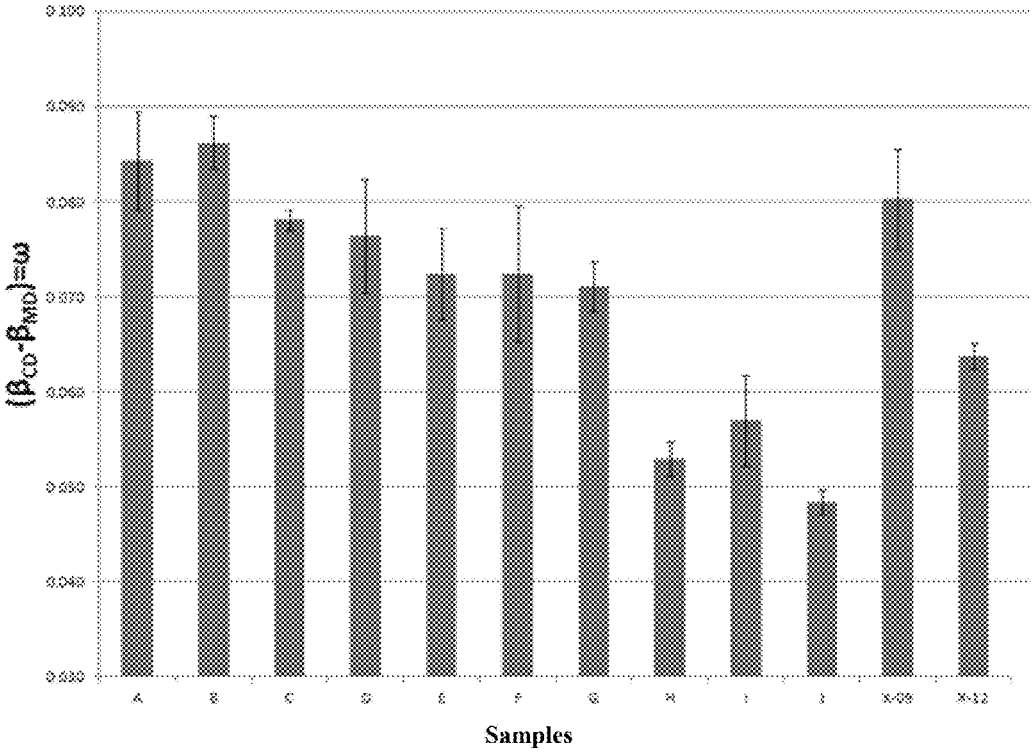
FIG. 1 depicts a chart comparing the fiber hygroexpansion stress transfer parameter ($\omega$) for samples A-J, X-09, and X-12.

The present invention is generally directed to a paper sheet.

Although this invention is susceptible to embodiment in many different forms, certain embodiments of the invention are described. It should be understood, however, that the present disclosure is to be considered as an exemplification of the principles of this invention and is not intended to limit the invention to the embodiments illustrated.

In one aspect, the present invention provides a paper sheet. As used herein, the term "paper sheet" refers to a substrate comprising a web of cellulose fibers. In some embodiments, the paper sheet does not undergo any finishing steps prior to its intended end use. In other embodiments, the paper sheet, after formation, may be subjected to any art-accepted finishing steps. Paper sheets of the present invention are particularly suitable for use in laser printers because of the low incidence of jamming associated with the sheets. However, the paper sheet of the present invention may also be beneficially used in various other uses, including, for example, in ink-jet printing, photocopying, and use in multifunction printers.

It has been discovered that the paper sheet of the present invention, having a basis weight of about 50 to about 80 g/m$^2$, comprising both hardwood kraft pulp and sulfite pulp, and having a MD/CD TSI ratio of 1.25 to 2.15, and a fiber hygroexpansion stress transfer parameter ($\omega$) of less than 0.1, is able to overcome considerable drawbacks associated with papers of the prior art. In particular, when used in laser printing applications, prior art paper very commonly jams (pre- and post-imaging), curls, becomes wavy at the edges, and/or shrinks asymmetrically. These problems may be associated with various dimensional changes to a paper sheet as the toner is being fused to the sheet surface.

The unique fiber furnish and properties of the paper sheet of the present invention allow the sheet to function acceptably over a wide range of temperatures and humidity, and to overcome some or all of the problems associated with prior art paper.

The paper sheet of the present invention has a top surface and a bottom surface. The sheet may be made, for example, using a Fourdrinier paper machine. Fourdrinier machines use a woven forming media or conveyor belt (called a "wire"), onto which a slurry of fibers is provided during paper formation. Thus, when the paper sheet of the present invention is formed on a Fourdrinier machine, one of the surfaces of the finished or unfinished paper sheet (either the top surface or the bottom surface) will have been in contact with the wire during paper formation, and that side is referred to as the "wire side". The opposite side of the paper sheet, which faces away from the wire during sheet formation, is referred to as the "top side".

In some embodiments, the paper sheet of the present invention has a basis weight of at least 45 g/m$^2$ measured by test TAPPI T410 om-98. In some embodiments, the paper sheet has a basis weight of less than 80 g/m$^2$. In some embodiments, the paper sheet may have a basis weight of 45, 50, 55, 60, 65, 70, 75, or 80 g/m$^2$, including any and all ranges and subranges therein. In some embodiments, the paper sheet has a basis weight of 50 to 80 g/m$^2$, for example, 52 to 68 g/m$^2$, or 55 to 65 g/m$^2$, or 58 to 61 g/m$^2$.

The paper sheet of the present invention comprises cellulosic fiber in the form of wood pulp. The wood pulp makes up the fiber furnish of the paper sheet. In some embodiments, the paper sheet comprises hardwood kraft pulp and sulfite pulp. The sulfite pulp comprises hardwood and/or softwood.

Suitable sources of hardwood pulp are well-known in the art, and any art-recognized suitable sources may be used including, for example, acacia, ash, aspen, basswood, beech, birch, cottonwood, elm, eucalyptus, hornbeam, maple, oak, poplar, sweetgum, sycamore and tupelo. In some embodiments, suitable sources of hardwood pulp are tropical hardwoods, such as eucalyptus and acacia. In some embodiments, suitable sources of hardwood pulp include mixtures of various hardwood species.

Suitable sources of softwood pulp are well-known in the art, and any art-recognized suitable sources may be used including, for example, pine, spruce, fir, hemlock, cedar, and tamarack. In some embodiments, suitable sources of softwood pulp include mixtures of various softwood species.

In some embodiments, the hardwood kraft pulp comprises pulp from one or two or more different sources of hardwood pulp. In certain embodiments, the hardwood kraft pulp comprises eucalyptus. In some embodiments, the kraft pulp consists of pulp from one or more sources of hardwood pulp. For example, in some embodiments, the kraft pulp consists of eucalyptus pulp. The hardwood kraft pulp used in the paper sheet of the instant invention may comprise bleached and/or unbleached pulp. The hardwood kraft pulp used in the paper sheet of the instant invention may comprise refined and/or unrefined pulp.

In some embodiments, the paper sheet of the present invention comprises 10-80% by weight of hardwood kraft pulp, based on the total weight of the sheet. In some embodiments, the paper sheet may contain 10, 15, 20, 25, 30, 35, 40, 45, 50, 55, 60, 65, 70, 75, or 80 wt % of hardwood kraft pulp, including any and all ranges and subranges therein (e.g., 10-60%, 12-45% 15-85%, 25-35%, 50-85%, etc.).

Persons having ordinary skill in the art will understand that the fiber length of the hardwood kraft pulp will depend on the source or sources thereof. In some embodiments, the average fiber length is 0.5 to 2.5 mm, such as, for example, 0.5 to 2 mm, 0.6 to 0.8 mm, 0.7 to 1.2 mm, or 0.7 to 1.0 mm. In some embodiments, the average fiber length of the hardwood kraft pulp is less than 2 mm. In some embodiments, the average fiber length of the hardwood kraft pulp is 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, or 2.5 mm, including any and all ranges and subranges therein. In some embodiments, the fibers of the hardwood kraft pulp have a size distribution such that at least 65% of fibers are within ±0.2 mm of the average fiber length. Fiber lengths, widths, and fines percentages listed throughout this application are length weighted mean averages calculated following TAPPI T271 om-98 test methods.

In some embodiments, the sulfite pulp comprises pulp from one or two or more different sources of hardwood and/or softwood pulp. In certain embodiments, the sulfite pulp comprises a blend of mixed Northeastern US hardwoods and/or hemlock. In some embodiments, the sulfite pulp consists of pulp from one or two or more sources of hardwood and/or softwood pulp. The sulfite pulp used in the paper sheet of the instant invention may comprise bleached and/or unbleached pulp. The sulfite pulp may comprise refined and/or unrefined pulp. In some embodiments, the sulfite pulp comprises ammonia-based bisulfite pulp, which, in some embodiments, comprises hardwood pulp or softwood pulp or a combination thereof (e.g., a blend of Northeastern US hardwoods and/or hemlock).

In some embodiments, the paper sheet of the present invention comprises 10-70% by weight of sulfite pulp, based on the total weight of the sheet. In some embodiments, the paper sheet may contain 10, 15, 20, 25, 30, 35, 40, 45, 50, 55, 60, 65, or 70 wt % of sulfite pulp, including any and all ranges and subranges therein (e.g., 15-50%, 20-30%, 25-30%, etc.).

Persons having ordinary skill in the art will understand that the fiber length of the sulfite pulp will depend on the source or sources thereof. In some embodiments, the average fiber length is 0.1 to 2.0 mm, such as, for example, 0.1 to 1.4 mm, 0.2 to 1.2 mm, 0.7 to 1.1 mm, or 0.7 to 1.0 mm. In some embodiments, the average fiber length of the sulfite pulp is 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, or 2.0 mm, including any and all ranges and subranges therein. In some embodiments, the fibers of the sulfite pulp have a size distribution such that at least 65% of fibers are within ±0.2 mm of the average fiber length.

In some embodiments, the paper sheet of the present invention may also comprise, in addition to the hardwood kraft pulp and the sulfite pulp, softwood kraft pulp. The softwood kraft pulp comprises pulp from one or two or more different sources of softwood pulp. In certain embodiments, the softwood kraft pulp comprises, for example, southern bleached softwood kraft pulp (SBSK) (generally, for example, a mix of one or more various southern pine species) and/or northern bleached softwood kraft pulp (NBSK) (generally, for example, a mix of one or more various northern pine species). The softwood kraft pulp used in the paper sheet of the instant invention may comprise bleached and/or unbleached pulp. The softwood kraft pulp may comprise refined and/or unrefined pulp.

In some embodiments, the paper sheet of the present invention comprises 5-50% by weight of softwood kraft pulp, based on the total weight of the sheet. In some embodiments, the paper sheet may contain 5, 10, 15, 20, 25, 30, 35, 40, 45, or 50 wt % of softwood kraft pulp, including any and all ranges and subranges therein (e.g., 5-30%, 6-25%, 7-20%, 8-15%, etc.).

Persons having ordinary skill in the art will understand that the fiber length of the softwood kraft pulp will depend on the source or sources thereof. In some embodiments, the average fiber length is 0.1 to 4.0 mm, for example, 1.5 to 3.0 mm. In some embodiments, the average fiber length of the softwood kraft pulp is 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or 4.0 mm, including any and all ranges and subranges therein. In some embodiments, the fibers of the softwood kraft pulp have a size distribution such that at least 65% of fibers are within ±0.2 mm of the average fiber length.

Persons having ordinary skill in the art will understand that the average fiber length of all of the pulp fibers in the paper sheet will depend on the sources thereof. In some embodiments, the average fiber length of all of the pulp fibers in the paper sheet of the present invention is 0.5-2.0 mm, for example, 0.7 to 1.2 or 0.8 to 0.95 mm. In some embodiments, the average fiber length of all of the pulp fibers in the paper sheet is less than 2 mm or less than 1 mm. In some embodiments, the average fiber length of all of the pulp fibers in the paper sheet is 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, or 2.5 mm, including any and all ranges and subranges therein.

In some embodiments, the paper sheet of the present invention has an average fiber count of less than 50,000 fibers/mg. In some embodiments, the average fiber count is 5,000, 10,000, 15,000, 20,000, 25,000, 30,000, 35,000, 40,000, 45,000, or 50,000 fibers/mg, including any and all ranges and subranges therein (e.g., 15,000-25,000 fibers/mg). In some embodiments, the average fiber count is more than 15,000 fibers/mg.

In some embodiments, the average fiber width of all of the pulp fibers in the paper sheet of the present invention is less than 30 μm. In some embodiments, the average fiber width of all of the pulp fibers in the paper sheet is 10, 11, 12, 13, 14, 15, 16, 17, 18, 19, 20, 21, 22, 23, 24, 25, 26, 27, 28, 29, or 30 μm, including any and all ranges and subranges therein (e.g., 15-25 μm, 15-20 μm).

In some embodiments, the collective pulp fibers of the paper sheet have distribution of orientation angles measured using an ultrasonic tester across the width of the paper machine that vary by less than 10 degrees and preferably less than 5 degrees. The ultrasonic technique is a composite measurement (i.e. bulk) that is the average of fiber angles between the top and bottom of the sheet.

In some embodiments, the paper sheet of the present invention has a machine direction/cross direction (MD/CD) tensile strength index (TSI) ratio of 1 to 2.5 (for example, 1.25 to 2.15, or 1.5 to 1.9, 1.55 to 1.8, or 1.6 to 1.75), as measured with the ultrasonic Technidyne Profile Plus TSA tester. The Technidyne unit has been found to read approximately 0.27 units higher than the L&W TSO tester, even though both are ultrasonic testers that use the same principle that the modulus of elasticity and density of a material determine the propagation of sound waves in a material. In some embodiments, the paper sheet of the present invention may have an MD/CD TSI ratio of 1, 1.1, 1.2, 1.3, 1.4, 1.5, 1.6, 1.7, 1.8, 1.9, 2.0, 2.1, 2.2, 2.3, 2.4, or 2.5, including any and all ranges and subranges therein.

Paper sheets of the present invention are characterized by having a fiber hygroexpansion stress transfer parameter (ω) of less than about 0.1. In some embodiments, the paper sheet has a ω of 0, 0.01, 0.02, 0.03, 0.04, 0.05, 0.06, 0.07, 0.08, 0.09, or 0.1, including any and all ranges and subranges therein.

Paper hygroexpansivity is a property that relates to the dimensional stability of paper. Since wood fibers swell under the influence of water, the dimensions and shape of paper change with changes in moisture content, which can lead to problems such as jamming, curl, wavy edges, asymmetric shrinkage during printing (for example, when passing through the fuser section of a laser printer or copier).

The fiber hygroexpansion stress transfer parameter ω is developed by considering the hygroexpansion coefficient, β, which is known to define the gradient of the curve between strain and relative humidity content given by Equation 1. Because both gradients are a percentage change in both numerator and denominator, β is unitless.

$$\beta_i = \frac{d\varepsilon_{h,i}}{dRH} \quad \text{(Equation 1)}$$

i=1=machine direction and i=2=cross machine direction in the paper. The hygroexpansion coefficient of the fiber in both the longitudinal (along the long axis) vs. the transverse (which will be defined radial) contribute to the MD and CD in-plane hygroexpansion as defined in Equation 2 and 3 as:

$$\beta_{MD}=\beta_L^f+f_{21}(\beta_T^f-\beta_L^f) \quad \text{(Equation 2)}$$

$$\beta_{CD}=\beta_L^f+f_{22}(\beta_r^f-\beta_L^f) \quad \text{(Equation 3)}$$

Where $f_{21}$ and $f_{22}$ represent the stress transfer parameter to the radial direction in the fiber from the fiber network in either the MD or CD direction. Because the hygroexpansion coefficients for a single fiber are much greater in the radial direction vs. the longitudinal, generally by a factor of 20× (i.e., $\beta_r^f >> \beta_L^f$), the equations may be simplified as:

$$\beta_{MD}=+\beta_L^f+f_{21}\beta_r^f \quad \text{(Equation 4)}$$

$$\beta_{CD}=\beta_L^f+f_{22}\beta_r^f \quad \text{(Equation 5)}$$

Equations 4 and 5 can be rearranged (see Equation 6) as the difference between the CD and MD fiber network hygroexpansion and will be termed, ω, the "fiber hygroexpansion stress transfer parameter".

$$\omega=(\beta_{CD}-\beta_{MD})=\beta_r^f(f_{22}-f_{21}) \quad \text{(Equation 6)}$$

The fiber hygroexpansion stress transfer parameter (ω) of the paper sheet of the present invention is one of several factors that contribute to the unexpected advantageousness of the paper sheet of the invention, including its resistance to jamming, curl, wavy edges, asymmetric shrinkage. In some embodiments, the co is less than 0.09 or less than 0.08 or less than 0.07 or less than 0.06 or less than 0.05.

In some embodiments, the paper sheet of the present invention has a smoothness on both the top surface and the bottom surface of less than 200 Sheffield using T538 om-96. The smoothness on the top surface may be the same as, or different from the smoothness on the bottom surface. In some embodiments, the smoothness on the top and bottom surface is less than 170 Sheffield, or less than 160 Sheffield. In some embodiments, the smoothness on the top and bottom surface is between 100 and 200 Sheffield, or between 110 and 160 Sheffield. In some embodiments, the paper sheet of the present invention may have smoothness on the top and bottom surface of 100, 110, 120, 130, 140, 150, 160, 170, 180, 190, or 200, including any and all ranges and subranges therein.

In some embodiments, the paper sheet of the present invention comprises broke. Broke includes paper trim or reject material from a paper machine or other paper mill operations that is repulped and used again to make paper. Broke can comprise hardwood and/or softwood pulp, either of which may be kraft and/or sulfite pulp. In some embodiments, the paper sheet of the present invention comprises 5 to 40% broke. In some embodiments, the paper sheet of the present invention may comprise 5, 10, 15, 20, 25, 30, 35, or 40 wt % broke, including any and all ranges and subranges therein (for example, 10-30%, 10-25%, or 12-18% broke). The paper sheet may comprise wet and/or dry broke.

In some embodiments, the paper sheet of the present invention may comprise any other desirable sources of pulp. For example, in some embodiments, the sheet may comprise Bleached Chemi-Thermo Mechanical Pulp (BCTMP), Market Deinked Pulp (MDIP), Thermo Mechanical Pulp (TMP), Stone Groundwood (SGW), Pressurized Stone Groundwood (PSGW) or Northern Unbleached Softwood Kraft (NUSK).

In some embodiments, a portion of the weight of the paper sheet of the present invention is attributed to reel moisture. For example, the sheet may comprise up to 10% reel moisture. In some embodiments, the paper sheet comprises 1, 2, 3, 4, 5, 6, 7, 8, 9, or 10% reel moisture, including any and all ranges and subranges therein (e.g., 2-8% reel moisture, or 3-6% reel moisture).

In some embodiments, the paper sheet of the present invention comprises one or more sizing agents. In some embodiments, the paper sheet contains less than 20 wt % of one or more sizing agents, for example, 0.01-15%, 0.5-10%, 1-8, or 2-6%. In some embodiments, the paper sheet of the present invention comprises 0, 1, 2, 3, 4, 5, 6, 7, 8, 9, 10, 11, 12, 13, 14, 15, 16, 17, 18, 19, or 20 wt % sizing agent, including any and all ranges and subranges therein.

Sizing agents are added to paper to contribute to varying degrees of moisture resistance. These additives can be applied in the papermachine "wet end" as an internal sizing agent or to the surface as a surface sizing agent. Examples of internal size additives can be found in the "Handbook for Pulp and Paper Technologists" by G. A. Smook (1992), Angus Wilde Publications. Typical internal size additives would include AKD (alkyl ketene dimer) such as EKA DR C222 supplied by Eka Chemicals Inc. and ASA (alkenyl succinic anhydride). Surface size additives are typically applied to the surface of paper by a size press or coater. Typical surface size additives include alkyl ketene dimer, styrene maleic anhydride, polyurethane, polyvinylamine and other such synthetic polymers. These additives are always added in conjunction with a binder such as starch, polyvinyl alcohol, carboxy methyl cellulose, alginate, etc. which can act as a "carrier".

Starch that is applied to the surface of the sheet is also referred to as "size" even though it has no water resisting properties by itself. Starch can be purchased in a "modified" or "unmodified" form. Examples of these starches are found in "Handbook for Pulp and Paper Technologists" mentioned above. Preferable examples of starches include, for example, oxidized, ethylated, cationic, hydroxyethylated, pearl, etc. The starch can come from any source, such as, e.g., potato, corn, wheat, tapioca. Starch that is added internally or to the surface of paper increases paper strength.

In some embodiments, the paper sheet comprises up to 50% by weight pulp fines. In some embodiments, the paper sheet of the present invention may comprise 1, 2, 3, 4, 5, 6, 7, 8, 9, 10, 11, 12, 13, 14, 15, 20, 25, 30, 35, 40, 45, or 50 wt % pulp fines, including any and all ranges and subranges therein. In some embodiments, the paper sheet comprises, e.g., 1-30%, 2-20%, 3-15%, 4-10%, or 4.5-8% by weight pulp fines. Pulp fines comprise solid particles, often derived from wood, small enough to pass through either a forming fabric, a 200-mesh screen, or a 76 um hole. In some embodiments, the pulp fines have a fiber length of less than 0.4 mm, for example, less than 0.2 mm Sources of fines in the paper sheet may include the hardwood kraft pulp, and/or the sulfite pulp, as well as any other sources of pulp.

In some embodiments, the paper sheet additionally comprises up to 40% by weight filler, for example, up to 30% or up to 20%, or up to 10% filler. The percent filler, as recited herein and throughout the application, is calculated according to T413 om-93 at 525 deg. C. In some embodiments, the paper sheet may contain 0, 5, 7, 10, 12, 15, 20, 25, 30, 35, or 40 wt % of filler, including any and all ranges and subranges therein (e.g., 5-20% or 7-10% or 5-15% or 5-12% filler). The filler may include any filler known in the art. Fillers may comprise inorganic solid particles, for example, in the size range of 0.2 to 5 μm. In some embodiments, the filler may include titanium dioxide, talc, calcium carbonate (including ground calcium carbonate, precipitated calcium carbonate and chemically modified calcium carbonate), clay, aluminum trihydrate, kaolin, gypsum (calcium sulfate), and/or satin white (calcium sulfoaluminate).

The paper sheet of the present invention may also include any additional optional substances known in the art. For example, other optional additives include, but are not limited to retention aids, binders, thickeners, fixatives, friction additives (e.g., lubricants such as EKA LC P60, a polyethylene lubricant supplied by Eka Chemicals Inc.), coating additives, preservatives, silicas, whitening agents (e.g., tetrasulpho- and hexasulpho-type agents such as Tinopal® ABP-A and Tinopal® SPP-Z, supplied by BASF Corporation) and solvents (including water). Examples of retention aids (e.g., Telioform M300 supplied by BASF Corporation Inc., CaroCat 125, and aluminum chlorohydrate such as ATC 8824 supplied by Eka Chemicals Inc.) include, but are not limited to coagulation agents, flocculation agents, and entrapment agents dispersed within the bulk and porosity enhancing additives cellulosic fibers. Examples of retention aids can also be found in U.S. Pat. No. 6,379,497. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6hexamethylene diisocyanate, diisocyanate, polyisocyanate, polyester, polyester resin, polyacrylate, polyacrylate resin, acrylate, and methacrylate. Examples of silicas include colloids and/or sols. Silicas include but are not limited to, sodium silicate and/or borosilicates.

In some embodiments, the paper sheet of the present invention has a caliper of 60-100 micron. Caliper refers to the average thickness of a paper sheet, determined by measuring the distance between smooth, flat plates at a defined pressure. In some embodiments, the paper sheet may have a caliper of 60, 65, 70, 75, 80, 85, 90, 95, or 100 μm, including any and all ranges and subranges therein. In some embodiments, the caliper may be 68-94 μm, for example, 78 to 88 p.m. In some embodiments, all portions of the paper sheet have a thickness within ±1 μm or ±1.5 μm or ±2 μm of the caliper.

In some embodiments, the paper sheet has a pre-set dryer bias curl of 5 to 15 mm. In some embodiments, the paper sheet of the present invention may have a pre-set dryer bias curl of 5, 6, 7, 8, 9, 10, 11, 12, 13, 14, 15, 16, 17, 18, 19, or 20 mm, including any and all ranges and subranges therein. In some embodiments, the dryer bias curl is set toward the surface corresponding to a top side of the paper sheet (i.e., the bias curl is set to an opposite surface of the paper sheet than a surface in contact with a Fourdrinier wire). In other embodiments, a dryer curl bias is set to toward the wire side of the paper sheet.

The paper sheet of the present invention may be made by contacting the cellulose fibers of the sheet with an internal and/or surface sizing solution. The contacting may occur anytime in the papermaking process including, but not limited to the wet end, head box, size press, water box, and/or coater. Further addition points include machine chest, stuff box, and suction of the fan pump. The cellulose fibers and any other sheet components may be contacted serially, consecutively, and/or simultaneously in any combination with each other. In some embodiments, the constituents of the paper sheet are mixed homogenously.

EXAMPLES

Samples A to J appearing in TABLE I below were produced on a commercial 3.4 meter wide Fourdinier paper machine (FP3.4) with a Dandy roll at a constant speed between 444 to 451 meter/minute. The samples were produced using a jet-to-wire ratio (where "jet" refers to the velocity of narrow stream of papermaking furnish that comes out of the slice opening from the headbox, and "wire" refers to the velocity of continuous belt of forming fabric) of 0.995 for Samples A-D, 0.997 for samples E and G, 1.01 for Sample F, 1.003 for Samples H and J, and 1.006 for Sample I.

TABLE I

| Weight % of Furnish Constituents in Paper Sheet | | | | | | | | | | |
|---|---|---|---|---|---|---|---|---|---|---|
| | Sample | | | | | | | | | |
| | A | B | C | D | E | F | G | H | I | J |
| Pulp | | | | | | | | | | |
| Hardwood Kraft: | | | | | | | | | | |
| Eucalyptus[1] | | | | | | 19.3 | 24.7 | 23.4 | 23.0 | 28.7 |
| Sulfite: | | | | | | | | | | |
| Ammonium based bi-sulfite - Unrefined[2] | 17.2 | 17.3 | 19.1 | 17.2 | 18.5 | 19.3 | 21.1 | 20.1 | 20.3 | 19.3 |
| Ammonium based bi-sulfite - Refined[2] | 20.1 | 8.7 | 6.4 | 20.1 | 6.2 | 6.4 | 7.0 | 6.0 | 7.4 | 7.3 |
| Softwood: | | | | | | | | | | |
| NBSK[3] | | | | | | | | | | 11.3 |
| SBSK[4] | 20.1 | 20.2 | 25.5 | 20.1 | 24.7 | 19.3 | 17.6 | 17.4 | 16.9 | |
| Bleached Chemi-Thermal Mechanical Pulp[5] | | 11.5 | 12.8 | | 12.4 | | | | | |
| Broke[6] | 13.5 | 13.5 | 14.9 | 13.5 | 14.5 | 15.0 | 16.5 | 15.6 | 15.8 | 15.6 |
| Filler[7] | 20.2 | 20.0 | 12.5 | 20.2 | 12.2 | 12.5 | 4.8 | 8.0 | 7.7 | 7.9 |
| Reel Moisture | 4.7 | 4.8 | 4.9 | 4.7 | 4.7 | 4.4 | 4.6 | 4.6 | 4.3 | 4.5 |
| Size Press Starch[8] | 2.5 | 2.2 | 2.1 | 2.5 | 5.0 | 2.0 | 1.9 | 3.2 | 2.7 | 3.5 |
| Other Additives[9] | 1.8 | 1.8 | 1.8 | 1.8 | 1.8 | 1.8 | 1.8 | 1.8 | 1.8 | 1.8 |
| Sum % | 100 | 100 | 100 | 100 | 100 | 100 | 100 | 100 | 100 | 100 |

[1]BEKP-91 plantation eucalyptus (*Eucalyptus grandisflora, Eucalyptus globus*), supplied by Lwarcel Cellulose

[2]Pulp furnish for Refined and Unrefined Ammonium based bi-sulfite pulp was a 50/50 Blend of Northeastern US hardwoods and Eastern hemlock (*Tsuga canadensis*), produced by Finch Paper LLC

[3]SFK-90, Canadian black spruce (*Picea mariana*), supplied by Fibrek Inc.

[4]AbiBow Southern Softwood, supplied by Abitibi-Bowater

[5]TEMCELL High Yield Aspen 325/85B (*Populus tremuloides*), supplied by Tembec

[6]Internally recycled fiber from Finch Paper LCC. The broke used in Samples A-J comprises roughly 15% recycled hardwood kraft pulp.

[7]Filler for A-G was Precipitated Calcium Carbonate ($CaCO_3$). Filler for H-J was $CaCO_3$ + KalOpaque CP, Anatase Titanium Dioxide ($TiO_2$)

[8]Casco ™ Industrial Corn Starch 030702, supplied by Corn Products International

[9]Other additives: Carocat 125, Eka DR C222, Telioform M300, ATC 8824, EKA LC P60, Tinopal ® ABP-A, Tinopal ® SPP-Z. A friction additive was also used in Sample J.

As used throughout, ranges are used as a short hand for describing each and every value that is within the range, including all subranges therein.

Numerous modifications and variations of the present invention are possible in light of the above teachings. It is, therefore, to be understood that within the scope of the accompanying claims, the invention may be practiced otherwise than as specifically described herein.

All of the references cited herein are hereby incorporated by reference with respect to relative portions related to the subject matter of the present invention and all of its embodiments.

The present invention is explained in more detail with the aid of the following embodiment examples which are not intended to limit the scope of the present invention in any manner.

The furnish in Sample A from TABLE I corresponds to a commercially available 404 offset basis weight (15.754 "bond"=59.2 g/m$^2$) (Finch Opaque White Wove, Grade 1094-040, catalog number 1090-4165, supplied by Finch Paper LLC). The offset basis weight convention is based on the weight of 500 sheets with dimensions 25"×38" while the bond basis weight convention is based on 500 sheets with dimensions of 17"×22". The metric convention is based only on a weight and surface area for any paper sheet.

For comparison purposes, commercially available samples of Boise® X-9® (ream part#0X9161) as both single reams and in cartons were purchased from Office Max. The samples are designated herein as "X-09" (corresponding to converting codes BC6C25812Z/6C25792A Apr. 13, 2009 23:55 87) and "X-12" (corresponding to converting code 812F1208B 19:44 respectively).

Samples X-09 and X-12 were analyzed and their fiber furnish was found to be mainly hardwood with a smaller amount of softwood (approximately an 80/20 ratio). The hardwood was found to comprise primarily aspen, while the softwood species comprise primarily pine and smaller amounts of spruce and hemlock fibers. The X-09 and X-12 sample sheets were found to comprise about 15.4% and 14.9% filler, respectively (comprising calcium carbonate) based on the weight of the sheet, and the sheets were found to have about 4.5 wt % ream moisture.

The results of a fiber analysis including coarseness followed TAPPI T271 om-98 using the OpTest FQA (OpTest Equipment Inc., Hawkesbury, ON, Canada) for Samples A-7 and comparative samples X-09 and X-12 are presented in TABLE II.

TABLE II

Fiber Properties of Samples A-J, X-09 and X-12

| | Sample | | | | | | | | | | | |
|---|---|---|---|---|---|---|---|---|---|---|---|---|
| | A | B | C | D | E | F | G | H | I | J | X-09 | X-12 |
| Avg. Fiber Count (fibers/mg) | 15,887 | 16,210 | 15,796 | n.d. | 14,352 | 15,032 | 16,966 | 17,056 | 19,561 | 21,048 | 12,706 | 10,863 |
| Avg. Fiber Length (mm) | 1.06 | 1.08 | 1.08 | n.d. | 1.16 | 1.07 | 0.98 | 0.98 | 0.97 | 0.89 | 1.25 | 1.49 |
| Avg. Fiber Width (μm) | 19.5 | 20.1 | 20.4 | n.d. | 20.6 | 19.7 | 18.6 | 17.5 | 17.4 | 16.7 | 21.9 | 20.5 |
| Fines (wt % of sheet) | 9.5 | 9.2 | 8.9 | n.d. | 8.8 | 8.1 | 6.5 | 5.4 | 5.8 | 5.3 | 4.9 | 8 |

The MD/CD TSI ratios of Samples A-7 and comparative samples X-09 and X-12 were measured using an ultrasonic Technidyne Profile Plus TSA tester.

The hygroexpansivities of Samples A-7 and comparative samples X-09 and X-12 were measured in triplicate on a TechPap VARIDIM Dimensional Stability Analyzer. The samples were selected from both ream and reel strip retains and fully characterized for caliper, $TSI_{MD/CD}$ and oven dry basis weight. Caliper was measured according to T411-om-97 and oven dry basis weight using both T410 om-98 and T412 om-92. The VARADIM test chamber procedure preconditions the samples to 50% RH and then measures the slope of the strain versus the moisture content curve between 30% relative humidity and when it reaches 50% relative humidity as defined by Equation 1. Values for ω, the fiber hygroexpansion stress transfer parameter, were determined using Equation 6. FIG. 1 depicts a chart comparing the fiber hygroexpansion stress transfer parameter to for the tested samples. As can be seen, from Sample A to J a 42% difference in co is shown. Samples J, H and I exhibited the lowest co values. The standard deviation bars are from propagation of the standard deviation for both $\beta_{CD}$ and $\beta_{MD}$.

Smoothness of the samples was measured by the Sheffield method following T538om-96.

The paper curl was measured off the production reels following ASTM 4825-97 with a constant 4.5% moisture target to determine aftersection dryer bias. Paper normally curls away from the last hot dryer can. A negative bias has a lower pressure (i.e. reduced temperature) in the bottom cans vs. the top cans and thus will induce a built in curl toward the top side of the sheet.

The results of the MD/CD TSI, ω, caliper, smoothness, aftersection dryer bias, and basis weight testing of Samples A-J, X-09 and X-12 are shown below in TABLE III.

TABLE III

Properties of Samples A-J, X-09 and X-12

| | Sample | | | | | |
|---|---|---|---|---|---|---|
| | A | B | C | D | E | F |
| Technidyne TSI (MD/CD) | 2.22 ± 0.06 | 2.33 ± 0.06 | 2.29 ± 0.10 | 2.20 ± 0.08 | 2.03 ± 0.07 | 1.92 ± 0.06 |
| $\beta_{CD}$ | 0.1384 | 0.1427 | 0.1318 | 0.128 | 0.1309 | 0.1294 |
| $\beta_{MD}$ | 0.0541 | 0.0565 | 0.0538 | 0.0516 | 0.0585 | 0.0569 |
| ω | 0.0843 | 0.0862 | 0.078 | 0.0764 | 0.0724 | 0.0725 |
| Caliper (micron) | 82.3 ± 1.2 | 87.9 ± 0.8 | 89.0 ± 1.8 | 83.5 ± 0.5 | 87.0 ± 1.1 | 87.4 ± 0.9 |
| Smoothness, Top (Reel Strip) | 125 | 149 | 154 | n.d. | 131 | 128 |
| Smoothness, Wire (Reel Strip) | 122 | 147 | 147 | n.d. | 136 | 128 |
| Aftersection Dryer Bias (bar) | −117.2 | −117.2 | −117.2 | −117.2 | −275.7 | −275.7 |
| Weight Basis (gsm) (oven dried) | 57.7 | 60 | 59.7 | n.d. | 59.1 | 58.9 |

TABLE III-continued

| Properties of Samples A-J, X-09 and X-12 | | | | | | |
|---|---|---|---|---|---|---|
| | Sample | | | | | |
| | G | H | I | J | X-09 | X-12 |
| Technidyne TSI (MD/CD) | 2.03 ± 0.02 | 1.74 ± 0.06 | 1.69 ± 0.06 | 1.67 ± 0.04 | 1.97 ± 0.02 | 1.77 ± 0.04 |
| $\beta_{CD}$ | 0.1248 | 0.1131 | 0.123 | 0.1024 | 0.1419 | 0.1202 |
| $\beta_{MD}$ | 0.0537 | 0.0601 | 0.0661 | 0.0539 | 0.0616 | 0.0564 |
| $\omega$ | 0.0711 | 0.053 | 0.0569 | 0.0485 | 0.0803 | 0.0637 |
| Caliper (micron) | 87.9 ± 0.8 | 82.9 ± 1.5 | 82.7 ± 0.8 | 83.7 ± 0.9 | 89.8 ± 0.5 | 87.6 ± 1.5 |
| Smoothness, Top (Reel Strip) | 128 | 124 | 150 | 137 | 154 | 171 |
| Smoothness, Wire (Reel Strip) | 109 | 145 | 139 | 140 | 181 | 182 |
| Aftersection Dryer Bias (bar) | −275.7 | −241.3 | −193.0 | −241.3 | n.d. | n.d. |
| Weight Basis (gsm) (oven dried) | 56.8 | 58.4 | 59.3 | 58.1 | 58.2 | 57.1 |

A heat curl lamp test was performed on Samples A-J, X-09, and X-12 using a test which is a modification of Tappi Useful Method 426 (UM 426), with results shown in TABLE IV. The heat lamp curl test is akin to a simplex printing operation in a laser printer or copier where the substrate is exposed to conductive heat transfer during fusing of the toner for a very short duration in the fuser nip. The modified test has a 375 watt heat lamp (Sylvania Infrared Industrial bulb S838) mounted 305 mm (12 inches) above the surface of a 101.6 mm (4 inch) square sample. The chamber dimensions in millimeters are 406×508×601, which results in minimal movement due to external air currents and only the "heat curl" is measured with a precision error of ±1 mm as defined by ASTM E177-10. The axis of curl, either MD or CD, with the Cartesian convention of x=MD (i.e. the machine direction from the wet end to the dry end), and y=CD (cross-machine Direction), is also recorded for the samples as well as the directionality with curl toward the lamp considered a positive value and away from the lamp as negative. During all of the experiments only positive curl was seen as the radiantly heated side of the sheet contracted when exposed to the heat lamp.

The deflection of the sample at each corner is related to the curl as well as the axis of curl through the quadratic approximation given by Lucisano and Vomhoff (Lucisano, M. F. C. and Vomhoff, H. "*A new instrument for measurement of the out-of-plane dimensional stability of paperboard*", PaperCon 2010, TAPP', Atlanta, Ga., May 2nd-5th, 2010.) who suggested that a "maximum out-plane-deviation of the four corners or an appropriate quantity derived from the out of plane deviation of the four corners could be used to characterize the dimensional stability of light weight papers . . . ". The derivation of Equation (7) was used applying this logic to the heat lamp curl data.

$$\zeta[\text{mm}]=\sqrt{[(z_1)^2+(z_2)^2+(z_3)^2+(z_4)^2]} \quad \text{(Equation 7)},$$

where $z_i[\text{mm}]=(x_i,y_i)$ for i=1 to 4

The heat lamp curl data in TABLE IV includes a mix of samples taken immediately off the jumbo parent reel at three CD positions across the front, middle and back of the paper machine at the time of manufacture (coded as RL) or ream samples (coded as RM) after the product rolls have been sheeted. The ream samples were tested on three consecutive sheets from multiple reams A ream sample is a composite sample of different unknown CD positions across the paper machine and thus this is a valid semi-quantitative comparison. The designation of the curl axis in TABLE IV as either MD or CD corresponds with two adjacent corners having the maximum deflection while a diagonal (D), which is also termed twist curl, corresponds to two opposite corners deflecting greater than the other corners.

TABLE IV

| Heat Lamp Curl Data for Samples A-J, X-09, and X-12 | | | | | | | | | | | | |
|---|---|---|---|---|---|---|---|---|---|---|---|---|
| | Sample I.D. | | | | | | | | | | | |
| | A | | B | | C | | E | | F | | G | |
| | Sample Type | | | | | | | | | | | |
| | RM | | RM | | RM | | RL | | RL | | RL | |
| | Value | Axis | Value | Axis | Value | Axis | Value | Axis | Value | Axis | Value | Axis |
| $\zeta_{ws}(1)$ [mm] | 28.8 | +CD | 34.4 | +CD | 34.3 | +CD | 1.4 | +CD | 5.1 | +CD | 1.4 | +CD |
| $\zeta_{ws}(2)$ [mm] | 22.8 | +CD | 24.4 | +CD | 41.9 | +CD | 11.0 | +D | 13.2 | +CD | 9.0 | +CD |
| $\zeta_{ws}(3)$ [mm] | 24.0 | +CD | 29.6 | +CD | 37.2 | +CD | | | | | 0.0 | Flat |
| $\zeta_{ws}$(avg) [mm] | 25.2 | | 29.4 | | 37.8 | | 6.2 | | 9.1 | | 3.5 | |
| $\zeta_{ts}(1)$ [mm] | 3.1 | −CD | 0.0 | Flat | 6.4 | +D | 9.6 | +MD | 0.0 | Flat | 22.2 | +MD |
| $\zeta_{ts}(2)$ [mm] | 0.0 | Flat | 0.0 | Flat | 6.3 | +D | 5.7 | +MD | 12.8 | +MD | 19.6 | +MD |

TABLE IV-continued

| Heat Lamp Curl Data for Samples A-J, X-09, and X-12 | | | | | | | | | | | | |
|---|---|---|---|---|---|---|---|---|---|---|---|---|
| $\zeta_{ts}(3)$ [mm] | 0.0 | Flat | 0.0 | Flat | 2.2 | +D | | | | | 15.2 | +D |
| $\zeta_{ts}$(avg) [mm] | 1.0 | | 0.0 | | 5.0 | | 7.7 | | 6.4 | | 19.0 | |
| $\zeta$(avg) [mm] | 13.09 | | 14.72 | | 21.38 | | 6.95 | | 7.78 | | 11.24 | |
| $\zeta_{ws}$(avg) + $\zeta_{ts}$(avg) [mm] | 26.19 | | 29.44 | | 42.76 | | 13.90 | | 15.57 | | 22.48 | |

| | Sample I.D. | | | | | | | | | | | |
|---|---|---|---|---|---|---|---|---|---|---|---|---|
| | H | | I | | J | | X-09 | | X-12 | | X-12 | |
| | Sample Type | | | | | | | | | | | |
| | RL | | RL | | RL | | RM | | RM | | RM | |
| | Value | Axis | Value | Axis | Value | Axis | Value | Axis | Value | Axis | Value | Axis |
| $\zeta_{ws}(1)$ [mm] | 0.0 | Flat | 0.0 | Flat | 0.0 | Flat | 2.2 | Flat | 7.4 | +CD | 5.7 | +MD |
| $\zeta_{ws}(2)$ [mm] | 0.0 | Flat | 0.0 | Flat | 0.0 | Flat | 1.0 | Flat | 4.1 | Flat | 9.8 | +MD |
| $\zeta_{ws}(3)$ [mm] | 0.0 | Flat | 0.0 | Flat | 0.0 | Flat | 0.0 | Flat | 18.0 | +MD | 13.2 | +MD |
| $\zeta_{ws}$(avg) [mm] | 0.0 | | 0.0 | | 0.0 | | 1.1 | | 9.9 | | 9.6 | |
| $\zeta_{ts}(1)$ [mm] | 6.2 | +MD | 11.2 | +MD | 5.2 | +D | 12.4 | +MD | 8.5 | +MD | 23.4 | +MD |
| $\zeta_{ts}(2)$ [mm] | 15.9 | +MD | 18.9 | +MD | 15.7 | +CD | 23.6 | +CD | 10.6 | +MD | 1.4 | Flat |
| $\zeta_{ts}(3)$ [mm] | 21.1 | +D | 34.0 | +D | 29.1 | +CD | 13.7 | +MD | 1.0 | Flat | 4.2 | +MD |
| $\zeta_{ts}$(avg) [mm] | 14.4 | | 21.4 | | 16.6 | | 16.6 | | 6.7 | | 9.7 | |
| $\zeta$(avg) [mm] | 7.20 | | 10.68 | | 8.32 | | 8.84 | | 8.29 | | 9.62 | |
| $\zeta_{ws}$(avg) + $\zeta_{ts}$(avg) [mm] | 14.40 | | 21.36 | | 16.65 | | 17.69 | | 16.58 | | 19.24 | |

As shown above, of the set of samples A to J that were produced, the two samples with the lowest defection were H and J while the first commercial sample X-12 had a $\zeta$(avg.) of 8.29 mm which was between the experimental samples respectively while the test on a separate ream had $\zeta$(avg.) of 9.62 mm. Sample J also has a very consistent sheet to sheet variability with all three sheets tested on the wire side achieving a flat profile.

As discussed above, the heat lamp curl test is akin to a simplex printing operation in a laser printer or copier where the substrate is exposed to conductive heat transfer during fusing of the toner for a very short duration in the fuser nip. Duplex laser and copier printing of a paper sheet represents a more demanding process where the substrate passes through a fuser section twice and the hygroexpansivity becomes more critical as sheet dimensions change leading to curl as moisture is vaporized from the substrate.

Office Environment Printer Testing for Curl, Wrinkling and Runnability.

Testing was conducted on Samples A, J, and X-12 in a simulated office environment on a Canon ImageRunner 6055 (iR-ADV 6055, iA6075 V2, Serial#HTT24909) monochrome multi-function printer/copier which had minimal wear and a printer starting counter at 518. The second unit was a new factory refurbished Brother HL-6570CDW (ROM V1.17, Serial#U62500G0J115019) which is capable of auto duplexing at a measured rate of 8 pages/minute with the test pattern after warm-up phase. The print setup and test patterns are given in TABLE V and ASTM F1442-92 followed for uniformity of test data. The pre-image and post-image curl magnitude was measured using ASTM 4825-97 and the definition of the axis of curl the same as described earlier for the heat lamp curl test. In simplex printing, the designation of TI or "toward image", is given a positive sign and AI or "away from image", is given a negative sign. The side that has contacted the hot fuser roller in the copier or laser print is the imaged side. For duplex printing, as used herein, TI or AI refers to the second (i.e. last) side imaged. Note this is a slight departure from the duplex print naming convention specified in ASTM F1442-92 where it refers to the first side imaged. Ideally, a substrate should have a low post-image curl in both simplex and duplex printing. Substrates that can duplex print with low curl and jam rates allow the end user to achieve higher product yield in terms of total usable printed area vs. a substrate that can only simplex print with low jam rates.

The humidity and temperature for the simulated office environment testing were recorded using a wet and dry bulb thermometer (Psychro-Dyne, Model PP100, Environmental Tectonics Corp.). Temperature over a single day test period was maintained at 22.5 to 24.4° C. and a relative humidity at 52-54% with precision sheeted samples A, J and X-12.

TABLE V

| Office Environment Test Conditions | | |
|---|---|---|
| | Canon iR 6055 | Brother HL-6570CDW |
| Sheet Size | US 8½" × 11" | US 8½" × 11" |
| Feed Tray | Paper Drawer 1 | Standard lower tray |
| Feed Direction | Grain short - Landscape | Grain long - Portrait |
| Printer Test Protocol | ASTM F1442-92 | ASTM F1442-92 |
| Simplex Test | Yes - 25 sheets | Yes - 10 sheets |
| Duplex Test | Yes - 25 sheets | Yes - 10 sheets |
| Paper Weight Mode | Thin - 52 to 63 gsm | Thin - 60 gsm |
| Test Pattern | 10 mm × 10 mm grid, 0.5 pt line | Diagonal multicolor text |
| Test Pattern Coverage % | 2.5% Black | Cyan 5%, Magenta 5.5%, Yellow 5.3%, Black 1.5% |
| External Features | Booklet Finisher/Stacker-E1 | None |

The results for samples A, J, and X-12 for the simplex and duplex testing on the Canon iR 6055 and the Brother 4570CDW are given in TABLE VI.

TABLE VI

Results of Simulated Office Environment Simplex and Duplex Curl Testing on Printer Platforms

| | | | Canon IR 6055 | | | | Brother 4570 CDW | | | |
|---|---|---|---|---|---|---|---|---|---|---|
| Sample I.D. | Simplex/ Duplex | Side Imaged | Curl (mm) | Axis (MD, CD, D) | Direction (TI/AI) | Curl Movement | Curl (mm) | Axis (MD, CD, D) | Direction (TI, AI) | Curl Movement |
| | | Pre-Image | 0 | n.a. | | n.a. | | | | |
| A.3.1 | S | Wire | 45 | MD | TI | | 15 | CD | TI | |
| | S | Top | −40 | MD | AI | 5 | −45 | MD | AI | 30 |
| | D | Wire-1'st | 30 | MD | TI | | 25 | CD | TI | |
| | D | Top-1'st | 50 | MD | TI | 80 | 70 | MD | TI | 95 |
| A.2.1 | S | Wire | 50 | MD | TI | | 10 | CD | TI | |
| | S | Top | −37.5 | MD | AI | 12.5 | −40 | MD | AI | 30 |
| | D | Wire-1'st | 35 | MD | TI | | 40 | CD | TI | |
| | D | Top-1'st | 67.5 | MD | TI | 102.5 | 65 | MD | TI | 105 |
| A.1.2 | S | Wire | 40 | MD | TI | | 15 | CD | TI | |
| | S | Top | −55 | MD | AI | 15 | −50 | MD | AI | 35 |
| | D | Wire-1'st | 35 | MD | TI | | 30 | CD | TI | |
| | D | Top-1'st | 60 | MD | TI | 95 | 50 | MD | TI | 80 |
| | | | Avg. Movement Simplex (mm) | | | 10.8 | Avg. Movement Simplex (mm) | | | 31.7 |
| | | | Avg. Movement Duplex (mm) | | | 92.5 | Avg. Movement Duplex (mm) | | | 93.3 |
| | | | | | | Total Simplex & Duplex Both Printers (mm) | | | | 228.3 |
| J.3.1 | S | Wire | −15 | CD | AI | | 15 | CD | TI | |
| | S | Top | 0 | Flat | Flat | 15 | 27.5 | CD | TI | 42.5 |
| | D | Wire-1'st | 22.5 | CD | TI | | 30 | CD | TI | |
| | D | Top-1'st | 10 | MD | TI | 32.5 | 10 | CD | TI | 40 |
| J.1.1 | S | Wire | 10 | MD | TI | | 20 | CD | TI | |
| | S | Top | 0 | Flat | Flat | 10 | 20 | CD | TI | 40 |
| | D | Wire-1'st | 0 | Flat | Flat | | 30 | CD | TI | |
| | D | Top-1'st | 15 | MD | TI | 15 | 15 | CD | TI | 45 |
| J.2.1 | S | Wire | −10 | CD | AI | | n.d. | n.d. | n.d. | n.d. |
| | S | Top | 0 | Flat | Flat | 10 | n.d. | n.d. | n.d. | n.d. |
| | D | Wire-1'st | 10 | CD | TI | | n.d. | n.d. | n.d. | n.d. |
| | D | Top-1'st | 10 | MD | TI | 20 | n.d. | n.d. | n.d. | n.d. |
| J.2.2 | S | Wire | n.d. | n.d. | n.d. | n.d. | 27.5 | CD | TI | |
| | S | Top | n.d. | n.d. | n.d. | n.d. | 15 | CD | TI | 42.5 |
| | D | Wire-1'st | n.d. | n.d. | n.d. | n.d. | 30 | CD | TI | |
| | D | Top-1'st | n.d. | n.d. | n.d. | n.d. | 10 | CD | TI | 40 |
| | | | Avg. Movement Simplex (mm) | | | 11.7 | Avg. Movement Simplex (mm) | | | 41.7 |
| | | | Avg. Movement Duplex (mm) | | | 22.5 | Avg. Movement Duplex (mm) | | | 41.7 |
| | | | | | | Total Simplex & Duplex Both Printers (mm) | | | | 117.5 |
| | | Pre-Image | 0 | n.a. | n.a. | | | | | |
| B-12.1.1 | S | Wire | 15 | MD | TI | | 20 | CD | TI | |
| | S | Top | −35 | MD | AI | 20 | −30 | MD | AI | 10 |
| | D | Wire-1'st | 25 | CD | TI | | 55 | CD | TI | |
| | D | Top-1'st | 30 | CD | TI | 55 | 50 | CD | TI | 105 |
| B-12.1.2 | S | Wire | n.d. | n.d. | n.d. | n.d. | 15 | CD | TI | |
| | S | Top | n.d. | n.d. | n.d. | n.d. | −25 | MD | AI | 10 |
| | D | Wire-1'st | n.d. | n.d. | n.d. | n.d. | 25 | CD | TI | |
| | D | Top-1'st | n.d. | n.d. | n.d. | n.d. | 45 | CD | TI | 70 |
| | | | Avg. Movement Simplex (mm) | | | 20 | Avg. Movement Simplex (mm) | | | 10.0 |
| | | | Avg. Movement Duplex (mm) | | | 55 | Avg. Movement Duplex (mm) | | | 87.5 |
| | | | | | | Total Simplex & Duplex Both Printers (mm) | | | | 172.5 |

As can be seen, testing on both printer platforms (the Canon iR 6055 and the Brother 4570CDW) demonstrated that Sample J has the lowest magnitude of curl whether imaged on the top or wire side of the sheet in duplex mode. The movement of curl is the difference between the wire and top sides for both curl magnitude and direction. For example, if the simplex top side curl is 15 mm CD/AI and the simplex wire side curl is 10 mm CD/AI then the total movement is 25 mm because the substrate has moved entirely through the neutral zero position when imaged between the two sides. If this substrate has the same top side 15 mm CD/AI simplex curl but the simplex wire curl is 5 mm CD/TI then the total movement is 5 mm and thus when either side is imaged the imaged side is curling toward the top side of the substrate.

Figure 2A:
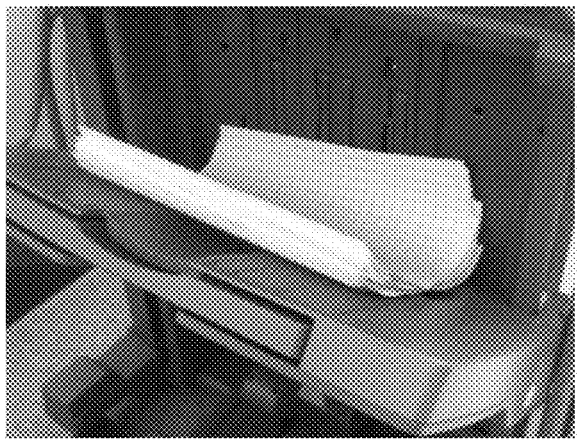
FIGS. 2A, 2B, and 2C are photographs of Samples A, J, and X-12, respectively, following simplex test printing on a Canon iR 6055 during simulated office environment testing.
Figure 2B:
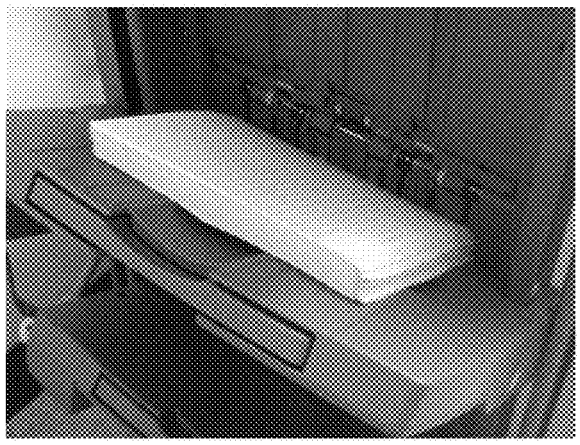
Figure 2C:
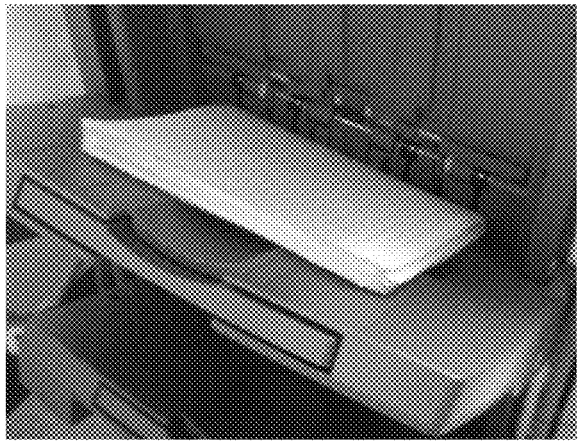

FIGS. 2A, 2B, and 2C are photographs of Samples A, J, and X-12, respectively, following simplex test printing on the Canon iR 6055 for 500 sheet runnability during the simulated office environment testing. The figures show each of the samples after the top side was imaged. As is evident in FIG. 2B, Sample J, an embodiment according to the present invention, exhibited minimum curl following simplex printing. The high MD simplex curl on Sample A (as shown in FIG. 2A) led to an unacceptable stacker performance with the sheet tripping the maximum tray height sensor at an earlier sheet count than the theoretical maximum and automatically switching to the second tray. For samples J and X-12 in FIGS. 2B and 2C, respectively, both samples had low simplex curl that did not prematurely trip the maximum height sensor in the stacker tray. No internal printer jams or wrinkles were experienced for the simplex and duplex 500 sheet runnability test on these three samples.

The advantageousness of the present invention is further demonstrated by the fact that Sample J had the lowest duplex curl movement on both platforms (Canon iR 6055 and Brother 6570CDW) with 22.5 and 41.7 mm respectively, as well as the lowest total simplex and duplex curl movement at 117.5 mm.

TAPPI Test Environment Printer Testing for Duplex Curl on Brother 4570CDW.

Additional testing of a larger sample set (Samples A-C, F, G, I, J, X-09, and X-12) was run on the Brother 4570 CDW in duplex mode at TAPPI standard conditions 50±2% RH and 23±1° C. specified by T502-cm-98. The same difference discussed earlier regarding the duplex naming convention specified in ASTM F1442-92 also applies to the results in Table VII. The caliper, stiffness and oven dry basis weight were measured on these ream samples and are also presented in Table VII.

TABLE VII

Results of Controlled Environment Testing
Conditions for Select Samples on Brother 4570 CDW

| | Sample ID | | | | | | | | | | | | | |
|---|---|---|---|---|---|---|---|---|---|---|---|---|---|---|
| | A | | | B | | | C | | | D | E | F | | |
| | Sample sub ID | | | | | | | | | | | | | |
| | A.3.1 | A.2.1 | A.1.2 | B.2.3 | B.2.1 | B.1.1 | C.1.1 | C.1.2 | C.2.1 | D | E | F.2.1 | F.2.2 | F.1.1 |
| Caliper (micron) T411-om97 | 77.1 ± 0.1 | 76.6 ± 0.8 | 76.3 ± 0.4 | 83.4 ± 0.8 | 82.8 ± 1.3 | 79.5 ± 1.1 | 85.3 ± 0.3 | 85.2 ± 0.6 | 85.7 ± 0.8 | n.d | n.d | 83.2 ± 0.2 | 3.2 ± 0.5 | 83.6 ± 0.3 |
| Stiffness (Gurley) MD T543 | 51 ± 1.4 | 71 ± 0.7 | 56 ± 4.2 | 69 ± 7.1 | 82 ± 5.7 | 62 ± 14.1 | 83.5 ± 7 | 77.5 ± 9.2 | 81.5 ± 1.4 | n.d | n.d | 78.5 ± 7.8 | 74 ± 4.2 | 82 ± 2.8 |
| Stiffness (Gurley) CD T543 | 31 ± 9.8 | 25 ± 2.8 | 29.5 ± 3.5 | 26 ± 2.8 | 29 ± 2.8 | 28 ± 5.7 | 39.5 ± 2.1 | 45 ± 1.4 | 34.5 ± 3.5 | n.d | n.d | 39 ± 4.2 | 38.5 ± 7.8 | 37.5 ± 6.4 |
| Duplex Wire Imaged-1st (mm) | 25 | 40 | 30 | 50 | 45 | 35 | 60 | 50 | 55 | n.d | n.d | 35 | 40 | 40 |
| Avg. Duplex Wire-1st (mm) | | 31.7 | | | 43.3 | | | 55.0 | | | | | 38.3 | |
| Axis (MD, CD) | CD | CD | CD | CD | CD | CD | CD | CD | CD | n.d | n.d | CD | CD | CD |
| Direction (TI, AI) | TI | TI | TI | TI | TI | TI | TI | TI | TI | n.d | n.d | TI | TI | TI |
| Duplex Top Imaged-1st (mm) | 70 | 65 | 50 | 70 | 75 | 67.5 | 70 | 70 | 70 | n.d | n.d | 35 | 30 | 25 |
| Avg. Duplex Top-1st (mm) | | 61.7 | | | 70.8 | | | 70.0 | | | | | 30.0 | |
| Axis (MD, CD) | MD | MD | MD | MD | MD | MD | MD | MD | MD | n.d | n.d | MD | MD | MD |
| Direction (TI, AI) | TI | TI | TI | TI | TI | TI | TI | TI | TI | n.d | n.d | TI | TI | TI |
| Duplex Curl Movement (mm) | 95 | 105 | 80 | 120 | 120 | 102.5 | 130 | 120 | 125 | n.d | n.d | 70 | 70 | 65 |
| Avg. Movement Duplex (mm) | | 93.3 | | | 114.2 | | | 125.0 | | n.d | n.d | | 68.3 | |
| Avg. Duplex Curl (mm) | | 46.7 | | | 57.1 | | | 62.5 | | n.d | n.d | | 34.2 | |

| | Sample ID | | | | | | | | | | | | | |
|---|---|---|---|---|---|---|---|---|---|---|---|---|---|---|
| | G | | | H | I | | | J | | | X-09 | X-12 | | |
| | Sample sub ID | | | | | | | | | | | | | |
| | G.1.1 | G.1.2 | G.3.2 | H | I.2.1 | I.2.2 | I.3.1 | J.3.1 | J.1.1 | J.2.1 | X-09.1.1 | X-12.1.1 | X.12.1.2 | X-12.1.3 |
| Caliper (micron) T411-om97 | 82.0 ± 0.6 | 80.8 ± 0.3 | 81.2 ± 0.1 | n.d | 79.4 ± 0.4 | 81.0 ± 0.3 | 80.9 ± 0.6 | 81.8 ± 0.2 | 81.2 ± 0.4 | 81.4 ± 0.1 | 82.2 ± 0.7 | 85.8 ± 0.1 | 80.8 ± 0.1 | 83.8 ± 0.3 |
| Stiffness (Gurley) MD T543 | 71.5 ± 0.7 | 82 ± 2.8 | 81.5 ± 2.8 | n.d | 64 ± 1.4 | 79 ± 1.4 | 77.5 ± 9.2 | 77 ± 7.1 | 69 ± 0.7 | 67 ± 1.4 | 83 ± 2.8 | 60 ± 10.6 | 62 ± 12.7 | 66 ± 4.9 |
| Stiffness (Gurley) CD T543 | 40.5 ± 2.1 | 50.5 ± 3.5 | 42.5 ± 4.9 | n.d | 40 ± 4.2 | 44 ± 1.4 | 37.5 ± 6.4 | 44 ± 0.1 | 44 ± 0.1 | 36 ± 4.2 | 38 ± 5.6 | 36 ± 2.1 | 34 ± 7.1 | 33 ± 5.7 |
| Duplex Wire Imaged-1st (mm) | 50 | 60 | 60 | n.d | 60 | 55 | 55 | 30 | 30 | 30 | 75 | 55 | 25 | 50 |
| Avg. Duplex Wire-1st (mm) | | 56.7 | | n.d | | 56.7 | | | 30.0 | | 75 | | 43.3 | |
| Axis (MD, CD) | CD | CD | CD | n.d | CD | CD | CD | CD | CD | CD | CD | CD | CD | CD |
| Direction (TI, AI) | TI | TI | TI | n.d | TI | TI | TI | TI | TI | TI | TI | TI | TI | TI |
| Duplex Top Imaged-1st (mm) | 25 | 35 | 30 | n.d | 20 | 27.5 | 22.5 | 10 | 15 | 10 | −10 | 50 | 45 | 25 |
| Avg. Duplex Top-1st (mm) | | 30.0 | | n.d | | 23.3 | | | 11.7 | | 10 | | 40.0 | |
| Axis (MD, CD) | MD | MD | MD | n.d | MD | MD | MD | CD | CD | CD | CD | CD | CD | CD |
| Direction (TI, AI) | TI | TI | TI | n.d | TI | TI | TI | TI | TI | TI | AI | TI | TI | AI |
| Duplex Curl Movement (mm) | 75 | 95 | 90 | n.d | 80 | 82.5 | 77.5 | 40 | 45 | 40 | 65 | 105 | 70 | 75 |
| Avg. Movement Duplex (mm) | | 86.7 | | n.d | | 80.0 | | | 41.7 | | 65.0 | | 89.3 | |
| Avg. Duplex Curl (mm) | | 43.3 | | n.d | | 40.0 | | | 20.8 | | 42.5 | | 41.7 | |

For the Brother 4570 CDW running in landscape mode, a CD axis of curl for both simplex and duplex printing is preferred. Sample J in Table VII has the lowest total curl movement in duplex mode for the different reams that were tested (J.1.1, J.2.1, and J.3.1). In a side by side comparison of Samples J.2.1 vs. X-12.1.3 which have equivalent Gurley stiffness values, the J.2.1. sample on an individual basis has lower duplex curl movement.

Figure 3A:
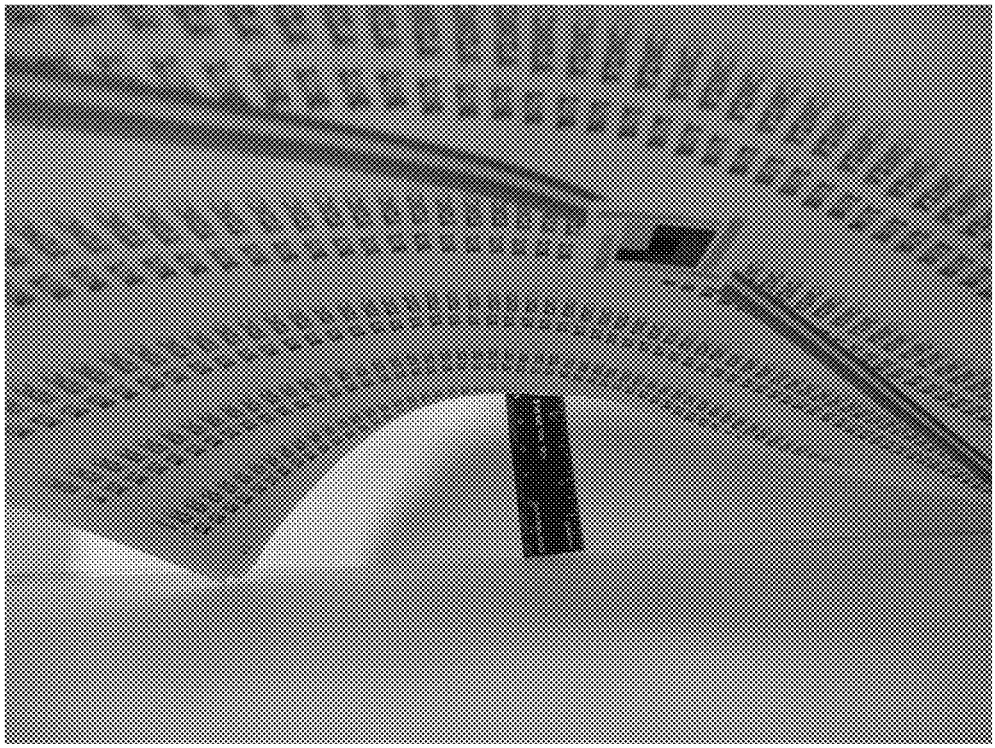
FIGS. 3A, 3B, and 3C are photographs of Samples A, J, and X-12, respectively, following duplex test printing on the Brother 4570CDW for curl performance during the TAPPI conditioned environment testing.
Figure 3B:
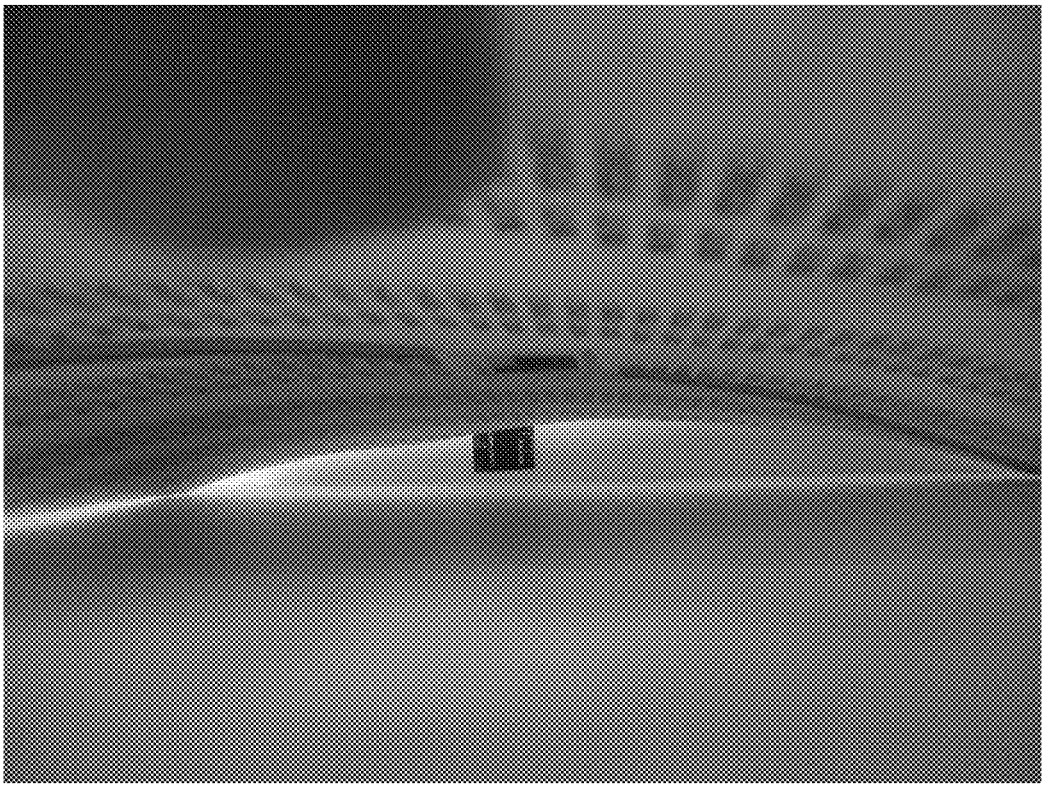
Figure 3C:
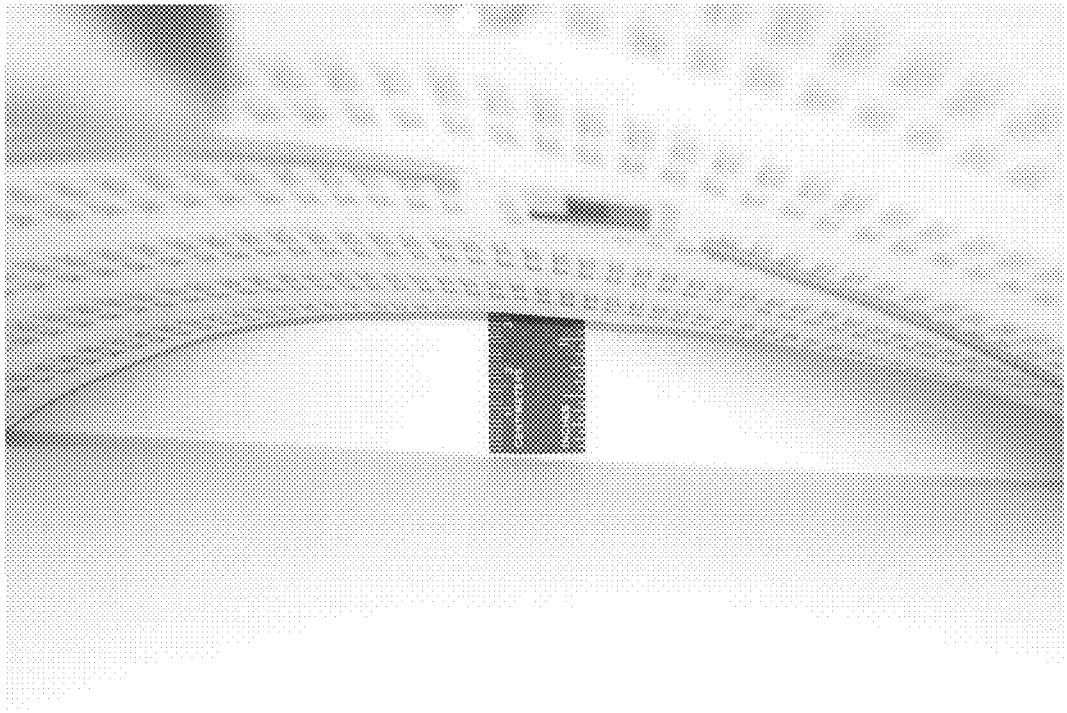

FIGS. 3A, 3B, and 3C are photographs of Samples A, J, and X-12, respectively, following duplex test printing on the Brother 4570CDW for curl performance during the TAPPI conditioned environment testing. The figures show each of the samples following duplex printing, where the top side was imaged first. As is evident, Sample J (shown in FIG. 3B) outperformed Samples A and X-12, exhibiting minimum curl following duplex printing.

Figure 4:
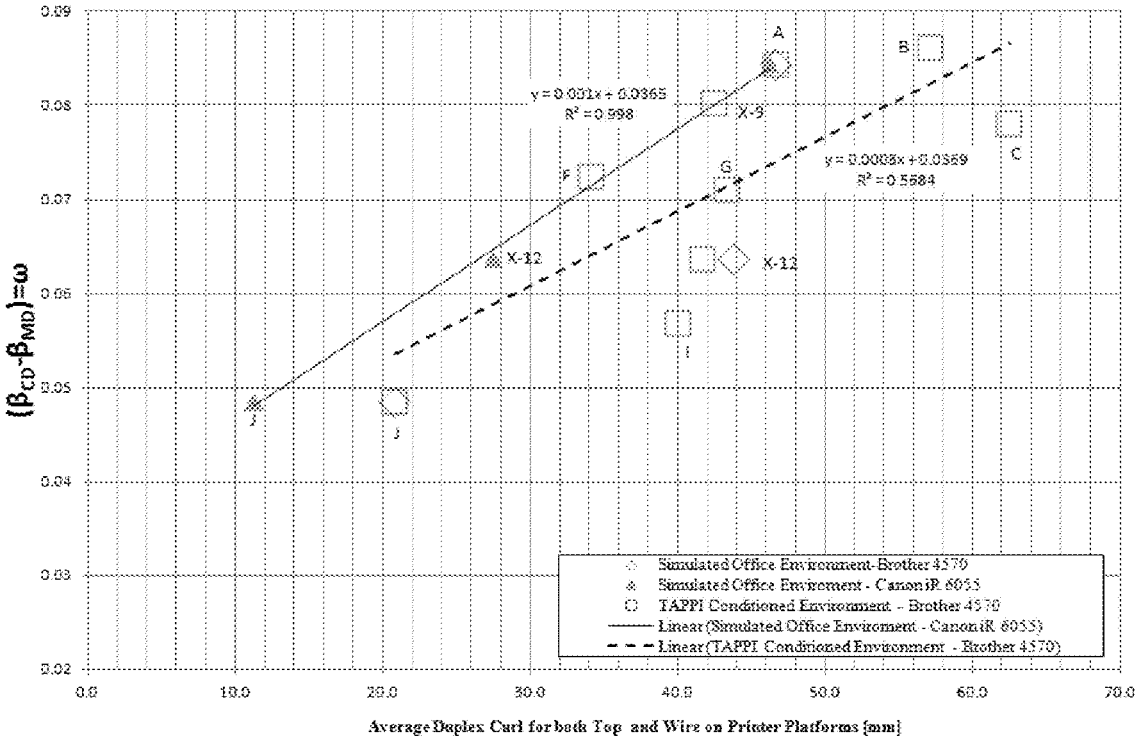
FIG. 4 depicts a plot which combines the fiber hygroexpansion stress transfer parameter ($\omega$) for Samples A, J and X-12 from TABLE III with the duplex curl data from TABLE VII.

FIG. 4 depicts a plot which combines the fiber hygroexpansion stress transfer parameter (ω) for Samples A, J and X-12 from TABLE III with the average duplex curl data from TABLE VII. FIG. 4 shows that a linear relationship is found for the curl performance vs. hygroexpansivity for these three samples, such that the samples with the lowest ω also tend to exhibit the least curl when duplex printed. FIG. 4 is consistent with the testing results, which indicate the superiority and advantageousness of low ω papers (for example, Sample J).

While several aspects and embodiments of the present invention have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the invention.

The invention claimed is:

1. A single ply paper sheet of 50 to 80 g/m$^2$ basis weight having a top surface and a bottom surface, said paper sheet comprising:

a. 10%-80% by weight of hardwood kraft pulp; and b. 10%-70% by weight of sulfite pulp;

and wherein the paper sheet has an MD/CD TSI ratio of 1.25 to 2.15, and a fiber hygroexpansion stress transfer parameter (w) of less than 0.1.

2. A paper sheet according to claim 1, wherein the w is less than 0.08.

3. A paper sheet according to claim 1, wherein the hardwood kraft pulp comprises eucalyptus.

4. A paper sheet according to claim 1, having a MD/CD TSI ratio of 1.5 to 1.9.

5. A paper sheet according to claim 4, wherein the hardwood kraft pulp comprises eucalyptus.

6. A paper sheet according to claim 1 further comprises:

c. 5%-50% by weight of softwood kraft pulp.

7. A paper sheet according to claim 6, wherein the hardwood kraft pulp comprises eucalyptus.

8. A paper sheet according to claim 7 comprising 3-15% pulp fines having a fiber length less than 0.4 mm.

9. A paper sheet according to claim 7 comprising 4-25% filler.

10. A paper sheet according to claim 9, wherein the filler comprises titanium dioxide, calcium carbonate, clay, aluminum trihydrate, or satin white.

11. A paper sheet according to claim 7, said paper sheet having a basis weight of 55 to 65 g/m$^2$.

12. A paper sheet according to claim 7, said paper sheet having a pre-set dryer bias curl of 5 to 15 mm.

13. The paper sheet of claim 12, wherein the dryer bias curl is set to a surface corresponding to a top side of the paper sheet.

14. A paper sheet according to claim 7, wherein the sulfite pulp comprises ammonia-based bisulfite pulp.

15. A paper sheet according to claim 14, wherein the ammonia-based bisulfite pulp comprises hardwood pulp and softwood pulp.

16. A paper sheet according to claim 7, said paper sheet having a caliper of 68 to 94 μm.

17. A paper sheet according to claim 7, wherein the ω is less than 0.06.

18. A paper sheet according to claim 6, having a MD/CD TSI ratio of 1.5 to 1.9.

19. A paper sheet according to claim 18, wherein the hardwood kraft pulp comprises eucalyptus.

20. A paper sheet according to claim 19, having a MD/CD TSI ratio of 1.6 to 1.8.

* * * * *